US006684038B2

(12) United States Patent
Nishimura

(10) Patent No.: US 6,684,038 B2
(45) Date of Patent: Jan. 27, 2004

(54) IMAGE FORMING APPARATUS WITH AN ELEMENT FOR REMOVING PAPER DUST FROM PHOTOSENSITIVE MEMBER

(75) Inventor: Soichiro Nishimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/026,654

(22) Filed: Dec. 27, 2001

(65) Prior Publication Data

US 2002/0081123 A1 Jun. 27, 2002

(30) Foreign Application Priority Data

Dec. 27, 2000 (JP) ..... 2000-397455

(51) Int. Cl.[7] ..... G03G 21/00
(52) U.S. Cl. ..... 399/98; 399/128
(58) Field of Search ..... 399/98, 127, 128, 399/343, 148–150

(56) References Cited

U.S. PATENT DOCUMENTS 6,038,415 A * 3/2000 Nishi et al. ..... 399/128 X
6,304,735 B1 * 10/2001 Nishimura et al. ..... 399/98

* cited by examiner

*Primary Examiner*—William J. Royer
(74) *Attorney, Agent, or Firm*—Oliff & Berridge, PLC

(57) ABSTRACT

A direct-current power source is connected, via a diode, to an electrically conductive brush, which makes contact with the surface of a photosensitive drum to remove paper dust deposited thereon. Upon application of a bias voltage by the direct-current power source to the conductive brush, the conductive brush collects paper dust physically as well as electrically. The diode prevents current flow from the conductive brush to the direct-current power source, and thus the paper dust collected by the conductive brush will not return to the photosensitive drum.

31 Claims, 2 Drawing Sheets

IMAGE FORMING APPARATUS WITH AN ELEMENT FOR REMOVING PAPER DUST FROM PHOTOSENSITIVE MEMBER

BACKGROUND OF THE INVENTION

1. Field of Invention

The invention relates to an electrophotographic image forming apparatus, such as a laser printer.

2. Description of Related Art

Electrophotographic image forming apparatus are well known in the art. These devices, such as a laser printer, typically include a photosensitive drum, a charger, a laser scanner, a developing roller, and a transfer roller. After the surface of the photosensitive drum is uniformly charged by the charger, the surface of the photosensitive drum is irradiated with a laser beam emitted from the laser scanner, and an electrostatic latent image is formed based on predetermined image data.

Toner carried on the developing roller is supplied to the electrostatic latent image formed on the surface of the photosensitive drum. The toner deposited on the surface of the photosensitive drum is transferred to a sheet passing between the photosensitive drum and the transfer roller.

SUMMARY OF THE INVENTION

Paper dust is deposited on the surface of a photosensitive drum when a sheet passes between the photosensitive drum and a transfer roller. If any paper dust remains on the photosensitive drum, a charger is prevented from uniformly charging the surface of the photosensitive drum and print quality deteriorates. An image forming device structured according to the apparatus of this invention efficiently removes paper dust deposited on the surface of the photosensitive drum. This is preferably achieved using an electrically conductive brush.

Generally, when paper dust on a photosensitive drum is electrically collected by applying a bias voltage to a conductive brush and if a potential difference between the bias voltage applied to the conductive brush and the surface potential of the photosensitive drum is too great, electric discharge may occur between the conductive brush and the photosensitive drum. Therefore, the bias voltage applied to the conductive brush should be set so as not to differ greatly from the surface potential of the photosensitive drum.

The surface potential of the photosensitive drum varies greatly depending on changes of a transfer current of a transfer roller and the on/off state of a transfer bias. When the bias voltage applied to the conductive brush does not differ greatly from the surface potential of the photosensitive drum, the high-low relationship between the voltage applied to the conductive brush and the surface potential of the photosensitive drum may be reversed. In such a case, paper dust collected by the conductive brush will be released to the surface of the photosensitive drum.

To solve this problem, the surface potential of the photosensitive drum should be kept stabilized at any given time and the relationship between the surface potential of the photosensitive drum and the bias voltage applied to the conductive brush should be kept constant. To that end, a discharge lamp can be provided downstream from the transfer roller and upstream from the conductive brush with respect to the rotation direction of the photosensitive drum.

Providing a discharge lamp is advantageous in that the potential difference between the surface potential of the photosensitive drum and the bias voltage applied to the conductive brush is stabilized and that the conductive brush can stably collect paper dust. However, such a discharge lamp has recently been eliminated for design simplicity and cost reduction.

According to this invention, a diode is provided between the conductive brush and a power source for the conductive brush. Thus, paper dust deposited on the photosensitive drum can be electrically collected in a stable manner without the need for providing a discharge lamp. The diode is provided to prevent current flow from the photosensitive drum to the power source.

Even when the surface potential of the photosensitive drum varies depending on changes of the transfer current and the on/off state of the transfer bias, and even when the high-low relationship between the bias voltage applied to the conductive brush and the surface potential of the photosensitive drum is reversed, the diode prevents current flow from the photosensitive drum to the conductive brush. Therefore, no potential difference is caused between the photosensitive drum and the conductive brush, and the paper dust remains held by the conductive brush.

Because the paper dust collected by the conductive brush is not released to the photosensitive drum, the potential difference between the bias voltage applied by the power source to the conductive brush and the surface potential of the photosensitive drum can be minimized.

In one embodiment of the apparatus of the present invention, the bias voltage applied to the conductive brush is set at 400 V so as to differ by 100 V from the surface potential of the photosensitive drum set at 300V. With such a potential difference, no electric discharge is generated between the conductive brush and the photosensitive drum, and the ability of the conductive brush to remove paper dust may be improved.

The bias voltage applied to the conductive brush is set between the initial potential of the photosensitive drum charged by the charger and the potential of the unexposed portion of the photosensitive drum after the transfer of a visualized image to the sheet. However, when the transfer bias is off, the surface potential of the photosensitive drum may possibly become approximately 900 V and differ greatly from the bias voltage (400 V) applied to the conductive brush. In such a case, the diode provided between the conductive brush and the power source prevents current flow from the conductive brush to the power source. Thus, no potential difference is caused between the conductive brush and the photosensitive drum.

When the transfer bias is off, there is no sheet between the photosensitive drum and the transfer roller and no paper dust adheres to the photosensitive drum. In this case, if a potential difference is caused between the conductive brush and the photosensitive drum, the paper dust collected by the conductive brush could be released to the photosensitive drum. In this embodiment, however, no potential difference is caused between the conductive brush and the photosensitive drum, and thus the paper dust collected by the conductive brush remains held in place. Therefore, paper dust removing ability may be maintained without any control by a discharge lamp of the surface potential of the photosensitive drum. The apparatus of this embodiment of the present invention is advantageous in reducing the manufacturing cost of an image forming apparatus in that no discharge lamp is required for the structure.

By making the brush itself electrically conductive, for example, by dispersing conductive particles, such as carbon particles, or conductive fillers into the brush, paper dust deposited on the photosensitive drum can be collected physically as well as electrically. Thus, the ability of the brush to remove paper dust can be improved.

By setting the volume resistance of the conductive brush at less than $10^6$ Ω-cm, a potential difference great enough to allow the brush to electrically collect paper dust is obtained. It is preferable that the conductive brush is made of an acrylic resin into which conductive particles or fillers are dispersed. Although the brush can be made conductive by coating its surface with metal, the metal-coated brush may become too firm and rub strongly against the surface of the photosensitive drum. Strong abrasion will aggravate filming on the photosensitive drum with paper dust or toner. However, if the brush is too soft, its ability to remove paper dust will be reduced.

For these reasons, it is preferable to use a brush made of an acrylic resin into which conductive particles or fillers are dispersed. With this structure, the brush is made moderately firm and can offer sufficient paper dust removing ability while suppressing filming.

The brush is structured such that its length may be 6 mm or more and its engaging amount against the photosensitive drum may be 1 mm or more. When the length of the brush is less than 6 mm and the engaging amount of the brush is less than 1 mm, the brush may rub, at its tip, against the surface of the photosensitive drum and may be likely to cause filming on the photosensitive drum.

On the other hand, as shown in one embodiment, when the length of the brush is 6 mm or more and the engaging amount of the brush is 1 mm or more, the brush makes contact with the surface of the photosensitive drum with its tip curved slightly. Accordingly, the brush may offer a sufficient paper dust removing ability while suppressing filming on the photosensitive drum.

The fiber density of the brush may preferably be more than 7.75 kf/cm$^2$. When the fiber density of the brush is 7.75 kf/cm$^2$ or less, paper dust is likely to pass through the brush. When the fiber density of the brush is more than 7.75 kf/cm$^2$, the brush can satisfactorily collect paper dust. Accordingly, the ability of the brush to collect paper dust may be improved.

The fiber thickness of the brush may preferably be approximately 330 dt/48 f or less. When the fiber thickness of the brush is more than 330 dt/8 f, the brush may become too firm and may likely cause filming on the photosensitive drum. A brush satisfying the above-described requirements may offer an extremely high ability to remove paper dust deposited on the surface of the photosensitive drum.

BRIEF DESCRIPTION OF THE DRAWINGS

The invention will be described with reference to the accompanying drawings, in which like elements are labeled with like numbers and in which.

DETAILED DESCRIPTION OF PREFERRED EMBODIMENTS

Figure 1:
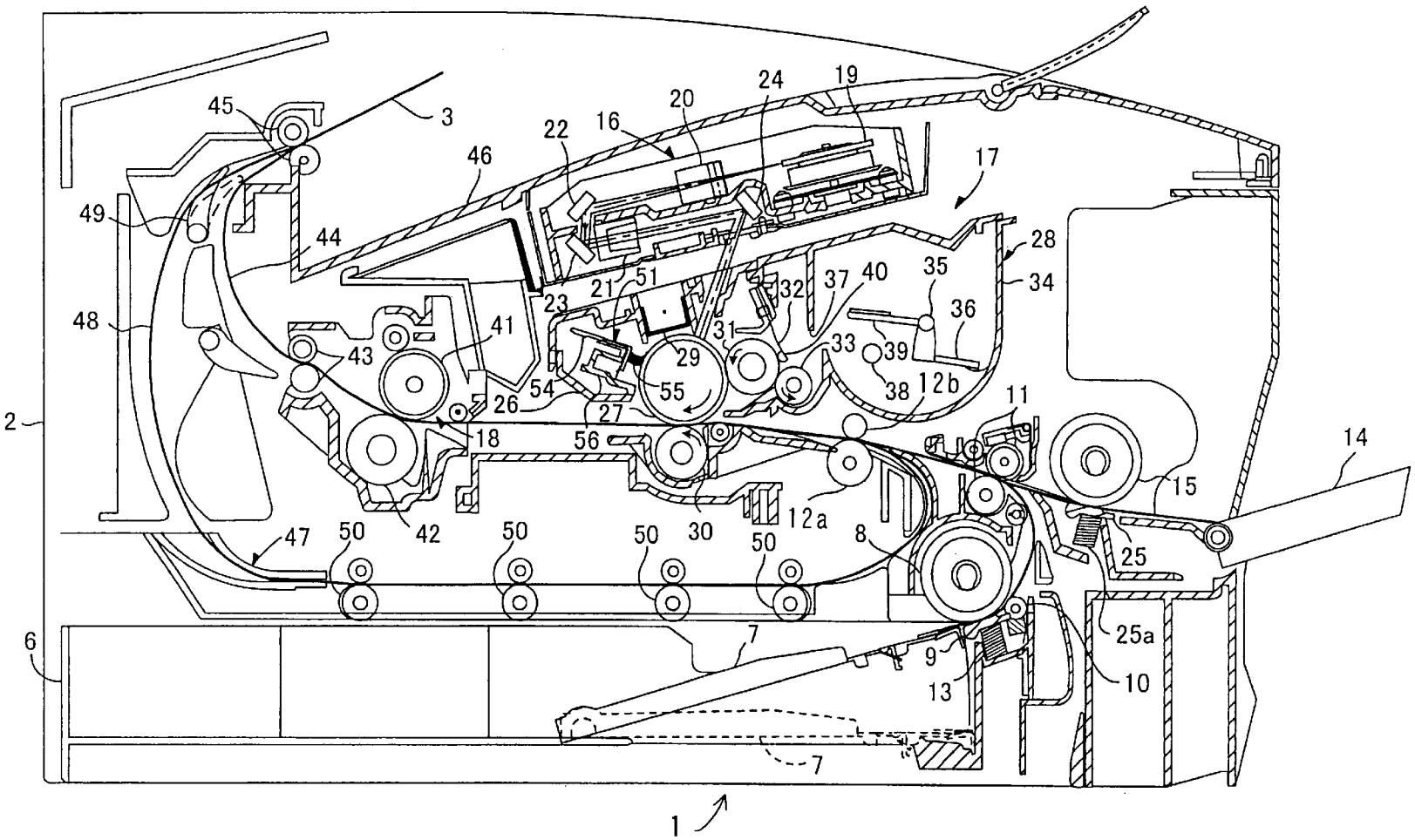
FIG. 1 is a side sectional view of the substantial parts of a laser printer according to one embodiment of this invention.

FIG. 1 is a side sectional view of the substantial parts of a laser printer 1. A sheet feed tray 6 is detachably attached to a bottom portion of a casing 2. A presser plate 7 is provided in the sheet feed tray 6 so as to support and upwardly press sheets 3 stacked in the sheet feet feed tray 6. A pickup roller 8 and a separation pad 9 are provided above one end of the sheet feed tray 6, and register rollers 12*a*, 12*b* are provided downstream from the pickup roller 8 with respect to the sheet conveying direction.

The presser plate 7 allows sheets 3 to be stacked thereon. The presser plate 7 is pivotally supported at its end remote from the pickup roller 8 such that the presser plate 7 is vertically movable at its end closer to the sheet pickup roller 8. The presser plate 7 is urged upwardly from its reverse side by a spring (not shown). When the stack of sheets 3 is increased in quantity, the presser plate 7 swings downwardly about the end of the presser plate 7 remote from the pickup roller 8, against the urging force from the spring. The pickup roller 8 and the separation pad 9 are disposed facing each other. The separation pad 9 is urged toward the pickup roller 8 by a spring 13 disposed on the reverse side of the separation pad 9.

An uppermost sheet 3 in the stack on the presser plate 7 is pressed against the pickup roller 8 by the spring provided on the reverse side of the presser plate 7, and the uppermost sheet 3 is pinched between the pickup roller 8 and the separation pad 9 when the pickup roller 8 rotates. Thus, print sheets 3 are fed one by one from the top.

After paper dust is removed from the sheet 3 by a paper dust removing roller 10, the sheet 3 is conveyed by conveyer rollers 11 to the resister rollers 12*a* and 12*b*. The register rollers 12*a* and 12*b* are made up of two rollers, that is, a driving roller 12*a* provided for the casing 2 and a driven roller 12*b* provided for a process unit 17, which will be described later. The driving roller 12*a* and the driven roller 12*b* make a surface-to-surface contact with each other. The sheet 3 conveyed by the conveyor rollers 11 is further conveyed downstream while being pinched between the driving roller 12*a* and the driven roller 12*b*.

The driving roller 12*a* is not driven before the sheet 3 makes contact with the driving roller 12*a*. After the sheet 3 makes contact with the driving roller 12*a* and the driving roller 12*a* corrects the orientation of the sheet 3, the driving roller 12*a* rotates and conveys the sheet 3 downstream.

A manual feed tray 14 from which sheets 3 are manually fed and a manual feed roller 15 that feeds sheets 3 stacked on the manual feed tray 14 are provided at the front of the casing 2. A separation pad 25 is disposed facing the manual feed roller 15. The separation pad 25 is urged toward the manual feed roller 15 by a spring 25*a* disposed on the reverse side of the separation pad 25. The sheets 3 stacked on the manual feed tray 14 are fed one by one while being pinched by the manual feed roller 15 and the separation pad 25 when the manual feed roller 15 rotates.

The casing 2 further includes a scanner unit 16, the process unit 17, and a fixing unit 18. The scanner unit 16 is provided in an upper portion of the casing 2 and has a laser emitting portion (not shown), a rotatable polygonal mirror 19, lenses 20 and 21, and reflecting mirrors 22, 23 and 24. A laser beam emitted from the laser emitting portion is modulated based on predetermined image data. The laser beam sequentially passes through or reflects from the optical elements, that is, the polygonal mirror 19, the lens 20, the reflecting mirrors 22, 23, the lens 21, and the reflecting mirror 24 in the order indicated by a broken line in FIG. 1. The laser beam is thus directed to and scanned at a high speed over the surface of a photosensitive drum 27, which will be described later.

Figure 2:
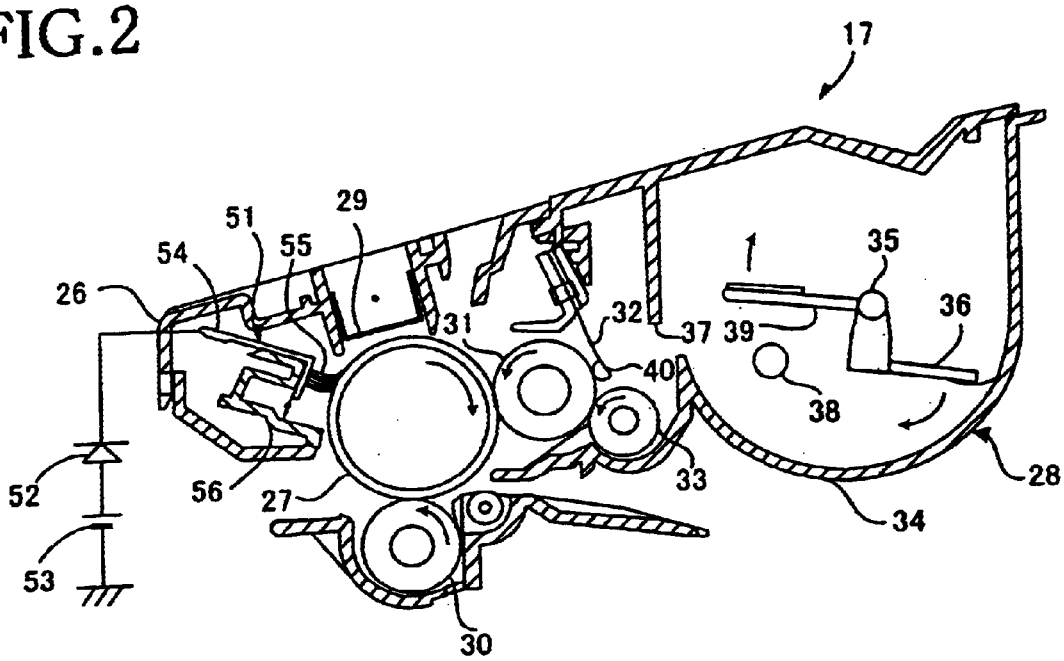
FIG. 2 is a side sectional view of the substantial parts of a process unit of the laser printer of FIG. 1.

FIG. 2 is an enlarged sectional view of the process unit 17. As shown in FIG. 2, the process unit 17 is disposed below the scanner unit 16 and has a drum cartridge 26 detachably attached to the casing 2 and a developing cartridge 28 detachably attached to the drum cartridge 26. The drum cartridge 26 includes the photosensitive drum 27, a scorotron charger 29, a transfer roller 30, and an electrically conductive brush frame 51. The developing cartridge 28 includes a developing roller 31, a layer thickness-regulating blade 32, a supply roller 33, and a toner box 34.

The toner box 34 contains positively charged nonmagnetic single-component toner, as a developing agent. The toner used in this embodiment is a polymerized toner obtained through copolymerization of styrene-based monomers, such as styrene, and acryl-based monomers, such as acrylic acid, alkyl (C1–C4) acrylate, alkyl (C1–C4) methacrylate, using a known polymerization method, such as suspension polymerization. The particle shape of such a polymerized toner is spherical, and thus the polymerized toner has excellent flowability.

A coloring agent, such as carbon black, and wax is added to the polymerized toner. An external additive, such as silica, is also added to the polymerized toner to improve flowability. The particle size of the polymerized toner is approximately 6–10 $\mu$m.

The toner in the toner box 34 is stirred by an agitator 36 supported by a rotating shaft 35 provided at a central portion of the toner box 34, and is discharged from a toner supply port 37 opened on one side of the toner box 34. A toner detection window 38 is provided on a sidewall of the toner box 34. The toner detection window 38 is wiped clean by a cleaner 39 supported by the rotating shaft 35.

The supply roller 33 is rotatably disposed adjacent to the toner supply port 37. The developing roller 31 is rotatably disposed facing the supply roller 33. The supply roller 33 is formed by covering a metallic roller shaft with an electrically conductive foam material. The developing roller 31 is formed by covering a metallic roller shaft with an electrically conductive rubber material. More specifically, the developing roller 31 is covered with an electrically conductive urethane or silicone rubber containing fine carbon particles, and topcoated with a urethane or silicone rubber containing fluorine. The supply roller 33 and the developing roller 31 are disposed in contact with each other so that they are press-deformed against each other to an appropriate extent. A predetermined developing bias is applied to the developing roller 31 with respect to the photosensitive drum 27.

The layer thickness-regulating blade 32 is disposed near the developing roller 31 to regulate the thickness of a toner layer formed on the surface of the developing roller 31. The layer thickness-regulating blade 32 has a metallic plate spring and a presser portion 40, which is disposed on a distal end of the plate spring and formed from an electrically insulative silicone rubber into a semicircular shape in section. The plate spring is supported, at its end opposite to its distal end, by the developing cartridge 28 so as to be close to the developing roller 31. The presser portion 40 is pressed against the developing roller 31 by an elastic force of the plate spring.

Toner discharged by the agitator 36 from the toner supply port 37 is supplied to the developing roller 31 when the supply roller 33 rotates. Toner is positively charged between the supply roller 33 and the developing roller 31 due to friction. After passing between the presser portion 40 and the developing roller 31, toner is formed into a thin layer of a predetermined thickness on the developing roller 31.

The photosensitive drum 27 is rotatably disposed adjacent to the drum cartridge 26 so as to be in contact with the developing roller 31. The photosensitive drum 27 is formed by coating a grounded cylindrical aluminum drum with a positively charged photosensitive layer made of polycarbonate.

The charger 29 is disposed at a predetermined interval upward from the photosensitive drum 27. The charger 29 is a scorotoron charger that produces corona discharge from a tungsten wire and positively charges the surface of the photosensitive drum 27 uniformly. The charger 29 is designed to charge the surface of the photosensitive drum 27 to a potential of approximately 900 V.

The transfer roller 30 is disposed below the photosensitive drum 27 and is rotatably supported by the drum cartridge 26 so as to face the photosensitive drum 27. The transfer roller 30 is formed by covering a metallic roller shaft with an electrically conductive rubber material. A power source (not shown) is connected to the roller shaft, and a predetermined transfer bias is applied to the roller shaft when toner on the photosensitive drum 27 is transferred to the sheet 3.

Figure 3:
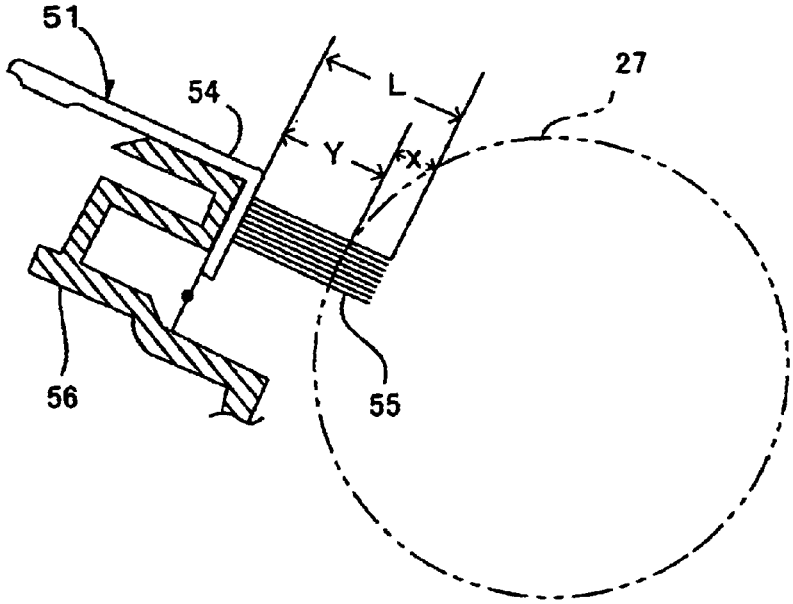
FIG. 3 illustrates the engaging amount of an electrically conductive brush against a surface of a photosensitive drum.

As shown in FIGS. 2 and 3, the conductive brush frame 51 has a substantially L-shaped metallic base member 54 and a brush 55 implanted on one end of the base member 54. The brush 55 is made of an acrylic resin into which conductive particles, such as carbon particles, or conductive fillers are dispersed. The base member 54 is attached to a brush frame 56, which extends integrally from the drum cartridge 26 toward the photosensitive drum 27. The tip of the brush 55 makes contact with the surface of the photosensitive drum 27. The conductive brush frame 51 faces the photosensitive drum 27 at a position downstream from the transfer roller 30 and upstream from the charger 29 with respect to the rotation direction of the photosensitive drum 27. The brush 55 is disposed so as to contact the photosensitive drum 27 along the entire length of the photosensitive drum 27.

A direct-current power source 53 is connected to the other end of the base member 54, and a diode 52 is connected between the direct-current power source 53 and the base member 54 to prevent backflow of current. The diode 52 is connected to allow current flow from the direct-current power source 53 to the conductive brush frame 51, and not to allow current flow from the conductive brush frame 51 to the direct-current power source 53. The direct-current power source 53 and the diode 52 are provided in the casing 2. The direct-current power source 53 applies a bias voltage of approximately 400 V to the conductive brush frame 51.

The diode 52 may be provided at the drum cartridge 26, and may be connected to the power source 53 via a known electrode provided at the drum cartridge 26. If the diode 52 is provided at the drum cartridge 26, the diode 52 will be easily replaced when broken. By detaching the drum cartridge 26 from the casing 2, a user may easily access the diode 52 to replace it.

As shown in FIG. 1, the fixing unit 18 is disposed downstream from the process unit 17 and has a heat roller 41, a pressure roller 42 pressed against the heat roller 41, and a pair of conveying rollers 43 provided downstream from the heat roller 41 and the pressure roller 42. The heat roller 41 is formed by an aluminum tube coated with a silicone rubber and a halogen lamp placed in the tube. Heat generated from the halogen lamp is transferred to the sheet 3 through the aluminum tube. The pressure roller 42 is made of a silicone rubber, which allows the sheet 3 to be easily removed from the heat roller 41 and the pressure roller 42.

The toner transferred to the sheet 3 by the process unit 17 melts and becomes fixed onto the sheet 3 due to heat, while the sheet 3 is passing between the heat roller 41 and the pressure roller 42. After the fixation is completed, the sheet 3 is conveyed downstream by the conveying rollers 43. An ejecting path 44 is formed downstream from the conveying rollers 43 to reverse the sheet conveying direction and guide the sheet 3 to an output tray 46 provided on the top surface of the laser printer 1. A pair of ejecting rollers 45 are provided at the upper end of the ejecting path 44 to eject the sheet 3 to the output tray 46.

The laser printer 1 is provided with a reverse conveying unit 47 that allows image forming on both sides of the sheet 3. The reverse conveying unit 47 includes ejecting rollers 45, a reverse conveying path 48, a flapper 49, and a plurality of pairs of reverse conveying rollers 50. The pair of ejecting rollers 45 can be switched between forward and reverse rotation. The ejecting rollers 45 rotate forward to eject the sheet 3 to the output tray 46, and rotate in reverse to reverse the sheet conveying direction.

The reverse conveying path 48 is vertically provided to guide the sheet 3 from the ejecting rollers 45 to the reverse conveying rollers 50 disposed above the sheet feed tray 6. The upstream end of the reverse conveying path 48 is located near the ejecting rollers 45, and the downstream end of the reverse conveying path 48 is located near the reverse conveying rollers 50.

The flapper 49 is swingably provided adjacent to a point branching into the ejecting path 44 and the reverse conveying path 48. The flapper 49 can be shifted between a first position shown by a solid line and a second position shown by a broken line. The flapper 49 is shifted by switching the excited state of a solenoid (not shown).

When the flapper 49 is at the first position, the sheet 3 guided along the ejecting path 44 is ejected by the ejecting rollers 45 to the output tray 46. When the flapper 49 is at the second position, the sheet 3 is conveyed to the reverse conveying path 48 by the ejecting rollers 45 rotating in reverse.

A plurality of pairs of reverse conveying rollers 50 are provided above the sheet feed tray 6 in a horizontal direction. A pair of reverse conveying rollers 50 on the most upstream side are located near the lower end of the reverse conveying path 48. A pair of reverse conveying rollers 50 on the most downstream side are located below the register rollers 12*a* and 12*b*.

The operation of the reverse conveying unit 47 when an image is formed on both sides of the sheet 3 will be described. The sheet 3 with a printed image on one side thereof is conveyed by the conveying rollers 43 along the ejecting path 44 toward the ejecting rollers 45. At this time, the flapper 49 is located at the first position. The ejecting rollers 45 rotate forward while pinching the sheet 3 to convey the sheet 3 temporarily toward the output tray 46. The ejecting rollers 45 stop rotating forward when the sheet 3 is almost ejected to the output tray 46 and the trailing edge of the sheet 3 is pinched by the ejecting rollers 45. In this state, the flapper 49 is shifted to the second position, and the ejecting rollers 45 rotate in reverse. The sheet 3 is conveyed in the reverse direction along the reverse conveying path 48. After the entire sheet 3 is conveyed to the reverse conveying path 48, the flapper 49 is shifted to the first position.

After the above actions have occurred, the sheet 3 is conveyed to the reverse conveying rollers 50, and conveyed upward by the reverse conveying rollers 50 to the register rollers 12*a* and 12*b*. The sheet 3 is then conveyed to the process unit 17 with its printed side facing down. As a result, an image is printed on both sides of the sheet 3.

The image forming operation will now be described. The surface of the photosensitive drum 27 is uniformly positively charged by the charger 29. The surface potential of the photosensitive drum 27 is approximately 900 V. When the surface of the photosensitive drum 27 is irradiated with a laser beam emitted from the scanner unit 16, electric charge is removed from a portion exposed to the laser beam, and the surface potential of the exposed portion becomes approximately 200V. In this way, the surface of the photosensitive drum 27 is divided into a high-potential portion (unexposed portion) and a low-potential portion (exposed portion), and thereby an electrostatic latent image is formed.

The surface potential of the unexposed portion is approximately 900 V, while the surface potential of the exposed portion is approximately 200 V.

When positively charged toner on the developing roller 31 faces the photosensitive drum 27, the toner is supplied to the low-potential exposed portion of the photosensitive drum 27. As a result, an electric latent image formed on the photosensitive drum 27 is visualized.

The developing roller 31 reclaims the toner remaining on the surface of the photosensitive drum 27. The remaining toner is the toner that has been supplied to the photosensitive drum 27 but not transferred from the photosensitive drum 27 to the sheet 3. The remaining toner adheres to the developing roller 31 by a Coulomb force generated due to a potential difference between the photosensitive drum 27 and the developing roller 31, and is reclaimed into the developing cartridge 28. With this method, a scraper that scrapes the remaining toner from the photosensitive drum 27 and a storage place for the scraped toner are not required. Thus, the laser printer 1 can be simplified in structure and made compact, and the manufacturing cost thereof can be reduced.

While the sheet 3 is passing between the photosensitive drum 27 and the transfer roller 30, the toner forming a visualized image on the photosensitive drum 27 is transferred to the sheet 3 by a Coulomb force generated due to a potential difference between the potential of the sheet 3 and the surface potential of the photosensitive drum 27. The surface potential of the unexposed portion of the photosensitive drum 27 is reduced from approximately 900 V to approximately 300 V by a transfer bias applied to the transfer roller 30.

When the toner is transferred to the sheet 3, paper dust contained in the sheet 3 adheres to the surface of the photosensitive drum 27. If the next charging process is performed with paper dust deposited on the surface of the photosensitive drum 27, the surface of the photosensitive drum 27 may not be uniformly charged, causing a deterioration in print quality.

In the laser printer 1 in this embodiment, the surface of the photosensitive drum 27 faces the brush 55. Therefore, the paper dust deposited on the photosensitive drum 27 is physically collected by the brush 55. In addition, the paper dust is electrically collected by the brush 55 when a bias voltage of approximately 400 V is applied to the brush 55. The surface potential of the unexposed portion of the photosensitive drum 27 after the toner is transferred to the sheet 3 is approximately 300 V, which differs by approximately 100 V from a bias voltage of approximately 400 V applied to the brush 55. Due to such a potential difference, the paper dust is efficiently collected by the brush 55.

Because a transfer bias is applied to the transfer roller 30 during the toner transfer to the sheet 3, the surface potential of the unexposed portion of the photosensitive drum 27 becomes 300 V. When the application of the transfer bias is stopped after the completion of toner transfer, the brush 55 may possibly make contact with the unexposed portion on the surface of the photosensitive drum 27, where an initial potential of 900 V charged by the charger 29 is maintained.

In such a case, backflow of current from the brush 55 to the direct-current power source 53 is produced due to a potential difference between the surface potential of the photosensitive drum 27 and the bias voltage applied to the brush 55. As a result, the paper dust collected by the brush 55 is released by a Coulomb force to the photosensitive drum 27.

At this time, toner is not transferred to the sheet 3 and paper dust will not newly adhere to the photosensitive drum 27. Thus, it is unnecessary for the brush 55 to collect newly deposited paper dust from the photosensitive drum 27, but it is only necessary for the brush 55 to hold the paper dust already collected. As far as the paper dust collected by the brush 55 is prevented from returning to the photosensitive drum 27, the brush 55 can continue to satisfactorily collect paper dust without a reduction in ability.

In the laser printer 1 in this embodiment, because the diode 52 is provided between the conductive brush frame 51 and the direct-current power source 53, any current flowing from the brush 55 to the direct-current power source 53 is not generated. Thus, the potential of the brush 55 equals the surface potential (900 V) of the photosensitive drum 27. There is no potential difference between the brush 55 and the photosensitive drum 27, and thus no Coulomb force acts on the paper dust collected by the brush 55. Therefore, the paper dust remains held by the brush 55 without returning to the photosensitive drum 27.

The surface potential of the photosensitive drum 27 may become higher than the bias voltage applied to the conductive brush frame 51, due to changes of the surface potential of the photosensitive drum 27 depending on on/off switching of the transfer bias and changes of the transfer current of the transfer roller 30. Even when this occurs, the diode 52 provided between the conductive brush frame 51 and the direct-current power source 53 prevents current flow from the photosensitive drum 27 to the direct-current power source 53. Therefore, the paper dust collected by the brush 55 remains held by the brush 55 and does not return to the photosensitive drum 27.

The bias voltage applied to the conductive brush frame 51 is set at 400 V, which is between the surface potential (approximately 300 V) of the unexposed portion of the photosensitive drum 27 after the toner transfer and the initial potential (approximately 900 V) of the photosensitive drum 27 charged by the scorotron charger 29. Therefore, electric discharge between the conductive brush frame 51 and the photosensitive drum 27 is reliably prevented, and paper dust can be satisfactorily removed.

The volume resistance of the brush 55 is less than $10^6$ Ω-cm and, more preferably, $10^2$–$10^4$ Ω-cm. When the volume resistance of the brush 55 is less than $10^6$ Ω-cm, a potential difference great enough to allow the brush 55 to collect charged paper dust is caused between the brush 55 and the photosensitive drum 27. In this state, paper dust can be more efficiently collected by the application of the bias voltage to the brush 55 by the direct-current power source 53. However, when the volume resistance of the brush 55 is $10^6$ Ω-cm or more, an electric field generated between the brush 55 and the photosensitive drum 27 is not strong enough to collect charged paper dust, and the ability of the brush 55 to remove paper dust is reduced.

The brush 55, made of an acrylic resin into which conductive particles, such as carbon particles, or conductive fillers are dispersed, is moderately firm. However, if the brush 55 is made of a metal-coated resin, the brush is excessively firm and rubs against the surface of the photosensitive drum 27 and aggravates filming on the photosensitive drum 27 with paper dust or toner. If too soft a brush 55 is used, the paper dust removing ability is reduced. By using the brush 55 of this embodiment, filming can be suppressed, and sufficient paper dust removing ability may be achieved.

In this embodiment, the length of the brush 55 is preferably 6 mm or more, and the engaging amount of the brush 55 against the photosensitive drum 27 is preferably 1 mm or more and, more preferably, 1–4 mm. When the engaging amount of the brush 55 is 1 mm or more, the brush 55 makes contact with the surface of the photosensitive drum 27 with its tip curved slightly. Accordingly, the brush 55 offers sufficient paper dust removing ability while suppressing filming on the photosensitive drum 27.

When the length of the brush 55 is less than 6 mm and the engaging amount of the brush 55 is less than 1 mm, the brush 55 rubs, at its tip, against the surface of the photosensitive drum 27 and is likely to cause filming on the photosensitive drum 27. However, when the engaging amount of the brush 55 is more than 4 mm, the brush 55 is excessively curved and its paper dust removing ability is reduced.

As shown in FIG. 3, the engaging amount of the brush 55 is defined as a length X, which is obtained by subtracting a distance Y between the base member 54 and the surface of the photosensitive drum 27 from a length L of the brush 55. The portion corresponding to the engaging amount X is curved, along the surface of the photosensitive drum 27, toward the downstream side with respect to the rotation direction of the photosensitive drum 27. Accordingly, the middle of the brush 55, instead of the tip of the brush 55, makes contact with the photosensitive drum 27. A measure of density kf/cm$^2$ (kilofilament/square centimeter) is used to represent the number of fibers per square centimeter. 7.75 kf/cm$^2$ indicates that 7750 fibers are implanted per square centimeter. The fiber density of the brush 55 is preferably greater than 7.75 kf/cm$^2$ and more preferably greater than 10.85 kf/cm$^2$, and still more preferably greater than 15.5 kf/cm$^2$. When the density of the brush 55 is 7.75 kf/cm$^2$ or less, paper dust may pass through the brush 55. When the density of the brush 55 is more than 7.75 kf/cm$^2$, the brush 55 can satisfactorily collect paper dust. Accordingly, the paper dust removing ability can be further improved.

The unit dt (decitex) represents the thickness of a gram of thread stretched to 10,000 meters. 330 dt/48 f indicates that the total thickness of 48 fibers is 330 times the thickness of a gram of thread stretched to 10,000 meters. A measure of fiber thickness dt/48 f (decitex/48 filaments) is used here. The fiber thickness of the brush 55 is preferably approximately 330 dt/48 f or less.

When the fiber thickness of the brush 55 is more than 330 dt/48 f, the brush 55 becomes firm and makes severe contact with the photosensitive drum 27. At this thickness the brush 55 is likely to cause filming on the photosensitive drum 27. However, when the fiber thickness of the brush 55 is approximately 330 dt/48 f or less, the brush 55 is less likely to cause filming and can satisfactorily remove paper dust. Instead of the conductive brush frame 51, a roller that makes contact with the surface of the photosensitive drum 27 can be used, with the brush 55, to remove the paper dust.

The advantages of the above-described brush 55 will now be described more specifically with reference to experimental examples where various types of brushes were used. The structure of a laser printer used for the experiments is the same as that of the printer 1.

EXPERIMENTAL EXAMPLE 1

Resistance of Brush

Three types of brushes varying in volume resistance were used to evaluate their paper dust removing ability. These brushes were set to have the same conditions except for the resistance. The following brushes were used:

I. a brush having a volume resistance of $10^2$ Ω-cm

II. a brush having a volume resistance of $10^4$ Ω-cm

III. a brush having a volume resistance of $10^6$ Ω-cm

Brushes I and II had substantially the same paper dust removing ability. Brush III had a low paper dust removing ability.

EXPERIMENTAL EXAMPLE 2

Length and Engaging Amount of Brush

Three types of brushes varying in length and engaging amount were used to evaluate the degree of filming caused by each one. These brushes were set to have the same conditions except for the length and the engaging amount. The following types of brushes were used:

I. a brush having a length of 5.5 mm and an engaging amount of 0.5 mm

II. a brush having a length of 6.5 mm and an engaging amount of 1.5 mm

III. a brush having a length of 7.5 mm and an engaging amount of 2.5 mm

Brush I rubs, at its tip, against the photosensitive drum and caused greater amounts of filming. Brush II caused less filming and attained satisfactory results. There was little difference, in the degree of filming caused, between brushes II and III, but brush III caused filming to occur at an earlier time.

EXPERIMENTAL EXAMPLE 3

Fiber Density of Brush

Three types of brushes varying in fiber density were used to evaluate their paper dust removing ability. These brushes were set to have the same conditions except for fiber density. The following types of brushes were used:

I. a brush having a fiber density of 7.75 kf/cm$^2$

II. a brush having a fiber density of 10.85 kf/cm$^2$

III. a brush having a fiber density of 15.5 kf/cm$^2$

Brush I did not remove paper dust sufficiently. Brush II removed paper dust satisfactorily. Brush III removed paper dust nearly perfectly.

EXPERIMENTAL EXAMPLE 4

Fiber Thickness of Brush

Two types of brushes varying in fiber thickness were used to evaluate their degree of filming caused. These brushes were set to have the same conditions except for the fiber thickness. The following brushes were used:

I. a brush having a fiber thickness of 330 dt/48 f

II. a brush having a fiber thickness of 440 dt/24 f

Brush I did not cause filming. Brush II caused some filming because the brush fibers were too firm.

As described above, it is desirable that the brush 55 with the volume resistance of $10^2$–$10^4$ Ω-cm is used to efficiently remove the paper dust from the photosensitive drum 27. When printing on a paper 3 which includes a lot of paper dust, the paper dust attached on the photosensitive drum 27 is easily taken into the vicinity of the developing roller 31 and the supply roller 33 via the developing roller 31. That causes the toner on the developing roller 31 to be poorly charged after completion of a number of paper printings.

That means the poorly charged toner is used to form an image on the paper 3 and remains on the photosensitive drum 27 after printing. The poorly charged toner is captured by the brush 55, and causes a poorly conditioned image and lessens the paper dust removing capability of brush 55. These poor conditions will occur if current flowing to the brush 55 is larger, i.e., the volume resistance of the brush 55 is lower. The brush 55 with the volume resistance of $10^7$–$10^9$ Ω-cm would result in a good conditioned image over a long because the poorly charged toner would not be captured on the brush 55 to a great extent. Instead, the poorly conditioned image might occur during a first short period because the capability of removing the paper dust during this period would not be as high.

Even if the brush 55 with such a high volume resistance is used, the volume resistance would be reduced based upon the circumference and humidity. Also a smaller current could flow from the brush 55 to the photosensitive drum 27, and vice versa. Therefore, an electrical component, i.e., a diode 52 connected between the brush 55 and the power source 53 would be effective to prevent current flow from the brush 55 to the power source 53 even if the volume resistance of the brush 55 is high. That causes the power source 53 and other electrically connected components to be protected from the unexpected over-current.

While this invention has been described in conjunction with specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. An image forming apparatus, comprising:

a photosensitive member on which an electrostatic latent image is formed;

a developing device that supplies a developing agent to the photosensitive member, based on the electrostatic latent image formed on the photosensitive member;

a transfer device that transfers the developing agent supplied by the developing device and held by the photosensitive member to a recording medium;

a paper dust removing member that removes paper dust deposited on the photosensitive member;

a power source that applies a bias to the paper dust removing member; and an electrical component that is connected between the paper dust removing member and the power source, the electrical component preventing current flow from the paper dust removing member to the power source, wherein a volume resistance of the paper dust removing member is less than $10^9$ Ω-cm.

2. The image forming apparatus according to claim 1, wherein the electrical component is a diode.

3. The image forming apparatus according to claim 2, further comprising a process cartridge that accommodates the photosensitive member, the process cartridge being detachably attached to the image forming apparatus;

wherein the diode is provided in the process cartridge.

4. The image forming apparatus according to claim 1, wherein a volume resistance of the paper dust removing member is less than $10^6$ Ω-cm.

5. The image forming apparatus according to claim 1, wherein the paper dust removing member is an electrically conductive brush.

6. The image forming apparatus according to claim 5, wherein the electrically conductive brush is made of an acrylic resin into which electrically conductive particles or fillers are dispersed.

7. The image forming apparatus according to claim 5, wherein a length of the electrically conductive brush is 6 mm or more, and an engaging amount of the electrically conductive brush against the photosensitive member is 1 mm or more.

8. The image forming apparatus according to claim 5, wherein a density of the electrically conductive brush is more than 7.75 kf/cm$^2$.

9. The image forming apparatus according to claim 5, wherein a fiber thickness of the electrically conductive brush is approximately 330 dt/48 f or less.

10. An image forming apparatus, comprising:

a photosensitive member;

a charging device that uniformly charges the photosensitive member;

an exposing device that selectively exposes the charged photosensitive member to form an electrostatic latent image thereon;

a developing device that supplies a developing agent to the photosensitive member based on the electrostatic latent image formed on the photosensitive member;

a transfer device that transfers the developing agent supplied by the developing device and held by the photosensitive member to a recording medium;

a paper dust removing member that removes paper dust deposited on the photosensitive member;

a power source that applies a bias to the paper dust removing member; and a diode that is connected between the paper dust removing member and the power source, wherein a potential of the bias applied to the paper dust removing member is set between an initial potential of the photosensitive member charged by the charging device and a potential of an unexposed portion of the photosensitive member after the developing agent is transferred to the recording medium.

11. The image forming apparatus according to claim 10, wherein the paper dust removing member is an electrically conductive brush, a length of the electrically conductive brush is 6 mm or more, and an engaging amount of the electrically conductive brush against the photosensitive member is 1 mm or more, a density of the electrically conductive brush is more than 7.75 kf/cm$^2$, and a fiber thickness of the electrically conductive brush is approximately 330 dt/48 f or less.

12. The image forming apparatus according to claim 11, wherein the electrically conductive brush is made of an acrylic resin into which electrically conductive particles or fillers are dispersed.

13. A method for removing paper dust from a photosensitive member of an image forming apparatus, comprising the steps of:

removing paper dust deposited on the photosensitive member with a paper dust removing member;

applying a bias voltage to the paper dust removing member with a power source;

preventing a current flow from the photosensitive member to the power source with a diode; and setting a volume resistance of the paper dust removing member at less than 10 Ω-cm.

14. The method of claim 13, wherein the step of removing paper dust from the photosensitive member is performed by an electrically conductive brush.

15. The method of claim 13, wherein the step of removing paper dust from the photosensitive member is performed by an electrically conductive brush of an acrylic resin into which electrically conductive particles or fillers are dispersed.

16. The method of claim 14, wherein the step of removing paper dust is performed by an electrically conductive brush that is 6 mm or more in length, and an engaging amount of the electrically conductive brush against the photosensitive member is 1 mm or more.

17. The method of claim 14, wherein the step of removing paper dust is performed by an electrically conductive brush having a density of more than 7.75 kf/cm$^2$.

18. The method of claim 14, wherein the step of removing paper dust is performed by an electrically conductive brush having a fiber thickness of approximately 330 dt/48 F or less.

19. The method of claim 13, further comprising the step of:

setting the potential of the bias voltage applied to the paper dust removing member between an initial potential of the photosensitive member charged by a charging device and a potential of an unexposed portion of the photosensitive member after a developing agent is transferred to a recording medium.

20. The method of claim 19, wherein the bias voltage is set by approximately 400 V.

21. The method of claim 13, further comprising a step of setting a volume resistance of the paper dust removing member by less than $10^6$ Ω-cm.

22. An image forming apparatus, comprising:

a photosensitive member on which an electrostatic latent image is formed;

a developing device that supplies a developing agent to the photosensitive member, based on the electrostatic latent image formed on the photosensitive member;

a transfer device that transfers the developing agent supplied by the developing device and held by the photosensitive member to a recording medium;

an electrically conductive brush that removes paper dust deposited on the photosensitive member;

a power source that applies a bias to the electrically conductive brush; and an electrical component that is connected between the electrically conductive brush and the power source, the electrical component preventing current flow from the electrically conductive brush to the power source.

23. The image forming apparatus according to claim 22, wherein the electrically conductive brush is made of an acrylic resin into which electrically conductive particles or fillers are dispersed.

24. The image forming apparatus according to claim 22, wherein a length of the electrically conductive brush is 6 mm or more, and an engaging amount of the electrically conductive brush against the photosensitive member is 1 mm or more.

25. The image forming apparatus according to claim 22, wherein a density of the electrically conductive brush is more than 7.75 kf/cm$^2$.

26. The image forming apparatus according to claim 22, wherein a fiber thickness of the electrically conductive brush is approximately 330 dt/48 f or less.

27. A method for removing paper dust from a photosensitive member of an image forming apparatus, comprising the steps of:

removing paper dust deposited on the photosensitive member with an electrically conductive brush;

applying a bias voltage to the electrically conductive brush with a power source; and preventing a current flow from the photosensitive member to the power source with a diode.

28. The method of claim 27, wherein the step of removing paper dust from the photosensitive member is performed by an electrically conducting brush of an acrylic resin into which electrically conductive particles or fillers are dispersed.

29. The method of claim 27, wherein the step of removing paper dust is performed by an electrically conductive brush that is 6 mm or more in length, and an engaging amount of the electrically conductive brush against the photosensitive member is 1 mm or more.

30. The method of claim 27, wherein the step of removing paper dust is performed by an electrically conductive brush having a density of more than 7.75 kf/cm$^2$.

31. The method of claim 27, wherein the step of removing paper dust is performed by an electrically conductive brush having a fiber thickness of approximately 330 dt/48 F or less.

* * * * *